United States Patent [19]

Higashi

[11] 4,291,503

[45] Sep. 29, 1981

[54] WORKPIECE TREATING BARREL

[76] Inventor: Yasunaga Higashi, 171-1 Ozuku-cho, Kashihara, Nara, Japan

[21] Appl. No.: 72,700

[22] Filed: Sep. 5, 1979

[51] Int. Cl.[3] ..... B24B 31/02

[52] U.S. Cl. ..... 51/164.1; 241/153; 241/183; 366/44

[58] Field of Search ..... 241/176, 177, 178, 153, 241/181, 182, 183; 366/44, 24, 25; 51/64.1, 7, 422

[56] References Cited

U.S. PATENT DOCUMENTS

| | | | |
|---|---|---|---|
| 889,560 | 6/1908 | Thull | 51/164.1 |
| 1,169,276 | 1/1916 | Nevill | 241/183 |
| 1,297,400 | 3/1919 | Ransohoff | 51/164.1 |
| 1,303,209 | 5/1919 | King | 51/164.1 |
| 1,420,757 | 6/1922 | Ryan | 366/25 |
| 1,826,822 | 10/1931 | Ransohoff | 51/164.1 |
| 2,298,016 | 10/1942 | Lincoln | 241/176 |
| 4,003,164 | 1/1977 | Carpenter | 51/422 |

FOREIGN PATENT DOCUMENTS

| | | | |
|---|---|---|---|
| 623578 | 9/1978 | U.S.S.R. | 241/183 |

*Primary Examiner*—Harold D. Whitehead
*Attorney, Agent, or Firm*—Holman & Stern

[57] ABSTRACT

A barrel apparatus for use in treating workpieces with grinding media, comprising a novel rotary barrel provided on its inner peripheral wall with a spiral flight extending lengthwise of the barrel and one or more ancillary flights extending straight or in an extremely modulated spiral form lengthwise of said barrel and intersecting the spirals of said first spiral flight, thereby accelerating the flow of the contents in the barrel to improve grinding efficiency, and further, permitting smooth delivery of the contents even when a small amount of the contents is present in the barrel.

7 Claims, 4 Drawing Figures

WORKPIECE TREATING BARREL

BACKGROUND OF THE INVENTION

The present invention relates to a barrel apparatus for use in treating workpieces with grinding media and, more particularly, to an improvement of such barrel device comprising a hollow barrel provided with a spiral flight on its inner peripheral wall and rotatably supported in horizontal position so as to grind the workpieces placed therein with the grinding media composed of a mixture of grinding particles, lubricating fluid, etc. therein, while being rotated.

Workpiece treating barrels of the prior art, while having a spiral flight on its inner periphery, have had certain defect in that they were designed to scoop up workpieces with the bottom part of the barrel by the action of the spiral flight only and move them forward from one end of the barrel to the other while being tumbled and dropped down onto the bottom part of the barrel during rotation of the barrel, with the result that the workpieces which fell down to the bottom of the barrel tend to deposit and gradually accumulate at the position where they fell, thus without being exposed to the grinding action of the flowing grinding media until the next spiral or band of said flight arrives to pick them up by rotation.

Further drawback of these barrels are that, when the amount of workpieces in the barrel is small or when the finished workpieces are being discharged, the barrel could not satisfactorily deliver them by the pushing action of such spiral flight only, thus causing a small amount of the contents to remain deposited and move back and forth in one pitch of said spiral flight.

BRIEF SUMMARY OF THE INVENTION

The primary object of the present invention is, therefore, to provide an improved workpiece treating barrel capable of overcoming the drawbacks of the known types of barrel by providing not only a spiral flight but also a novel ancillary flight on its inner peripheral wall, extending straight or in extremely modulated spiral form along the length of the barrel across the spirals or spiral bands of said spiral flight, in order to shorten the time of accumulation and depositing of the contents in the barrel thereby improving the grinding efficiency and also to ensure smooth delivery of the contents even when there is a small amount of the contents left in the barrel.

Another object of the present invention is to provide an improved type of such barrel apparatus using two or more of the barrels of the present invention in parallel arrangement in order to permit automatic circulation or cycling of the barrel contents between said two barrels.

There are still other features of the invention which will become apparent when taken in conjunction with the appended drawings.

BRIEF DESCRIPTION OF THE DRAWINGS

The drawings show some of the preferred embodiments of the present invention, actions thereof, and conditions of use, wherein.

DETAILED DESCRIPTION OF THE INVENTION

Figure 1:
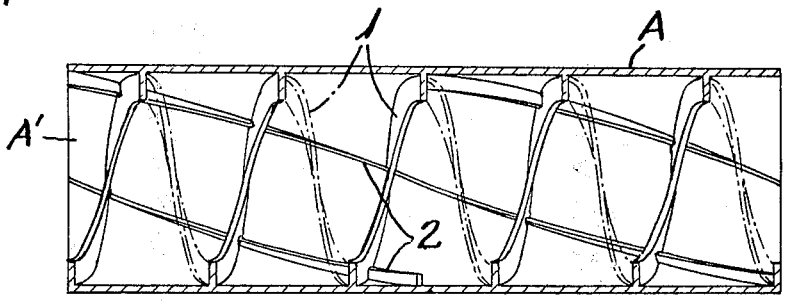
FIG. 1 is a vertical sectional view of a barrel according to the present invention.

Referring to FIG. 1, (A) is an open-ended cylindrical barrel having its one end (the left-hand end in the drawing) formed slightly larger than the other end in diameter. The element (1) is a spiral flight having its outer peripheral edge rigidly fixed to the inner peripheral wall of said barrel (A). The element (2) is an ancillary flight provided along the length of the barrel (A), intersecting the spirals of the spiral flight (1) and having its base end rigidly fixed to the inner peripheral wall (A') of said barrel (A). When providing a plurality of such ancillary flights, these flights are disposed in equal distance from one another in circumferential direction. These ancillary flights (2) are lower in height than said spiral flight (1), each being disposed in half a turn around the inner periphery of said barrel from one end to the other in the direction reverse to the direction of spiral of said spiral flight (1). Accordingly, each ancillary flight (2) extends in substantially straight line or in an extremely modulated spiral form, and also, this ancillary flight (2) may be disposed parallel to the axial line of the barrel (A) or in slightly inclined form in the same direction as said first spiral flight (1).

The barrel (A) constructed as above is designed to operate in such a manner that the workpieces are scooped up by the lateral part of said spiral flight (1), carried upward and released from said flight (1) at the upper part of the inner wall surface of the barrel (A), then tumbled and let fall down, upon which the workpieces collide with the simultaneously rotating second flight (2), disperse in longitudinal direction of said second flight (2) and fall down to the bottom part of the barrel (A).

Accordingly, the barrel (A) can carry out stirring and forwarding of the workpieces more than twice during the rotational angle of one pitch of said first flight (1) and simultaneously, shorten the time of accumulation and depositing of the contents until the next spiral of said flight (1) comes to work on them, thereby improving the grinding efficiency. Furthermore, with the additional forwarding action of the ancillary flight (2), the depositing and accumulation of the contents can be eliminated by a repetition of rising and falling of the contents within one pitch of said spiral flight (1), so that, even when treating a small amount of workpieces, the barrel (A) can provide smooth delivery of them, thus eliminating the chance of a small amount of workpieces remaining unfinished or untreated in the barrel (A).

Figure 2:
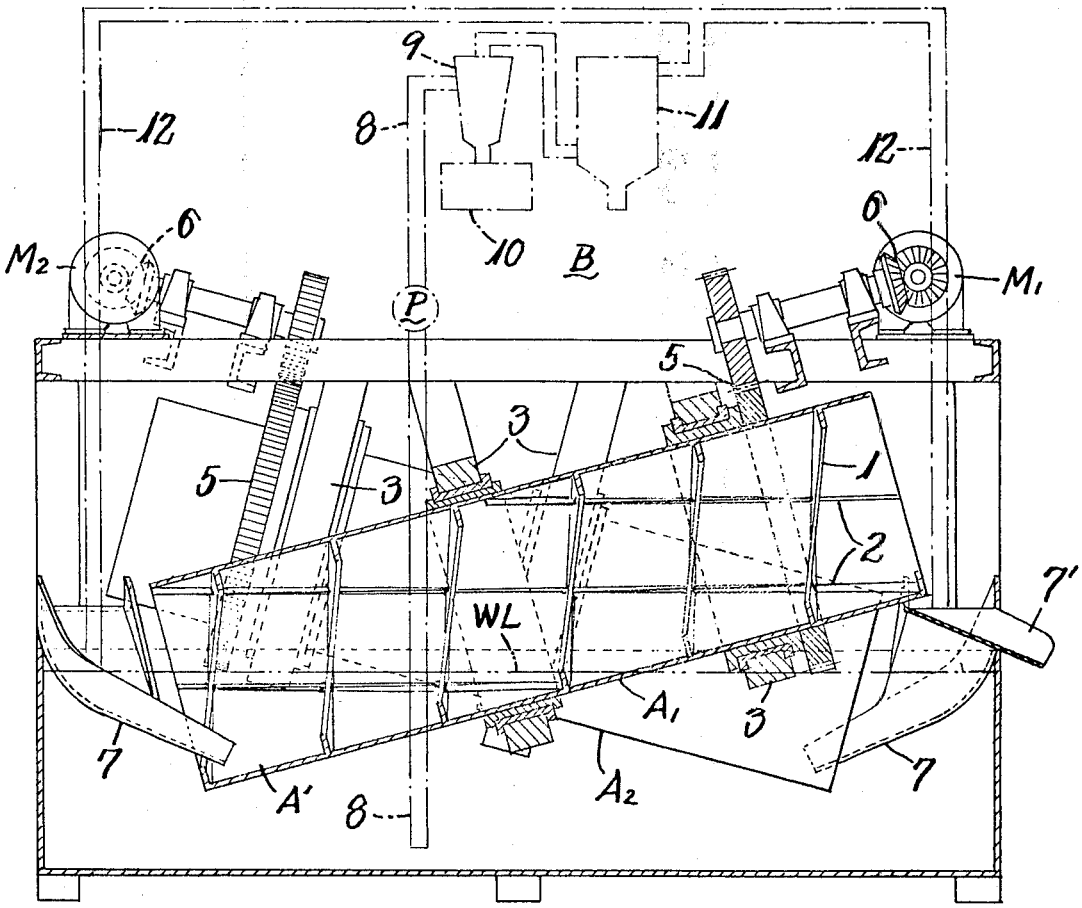
FIG. 2 is a front view, partly in section, of a workpiece treating barrel apparatus using a pair of the barrels of FIG. 1 so disposed as to permit the workpieces and the grinding media therein to be automatically cycled or circulated between said two barrels.
Figure 3:
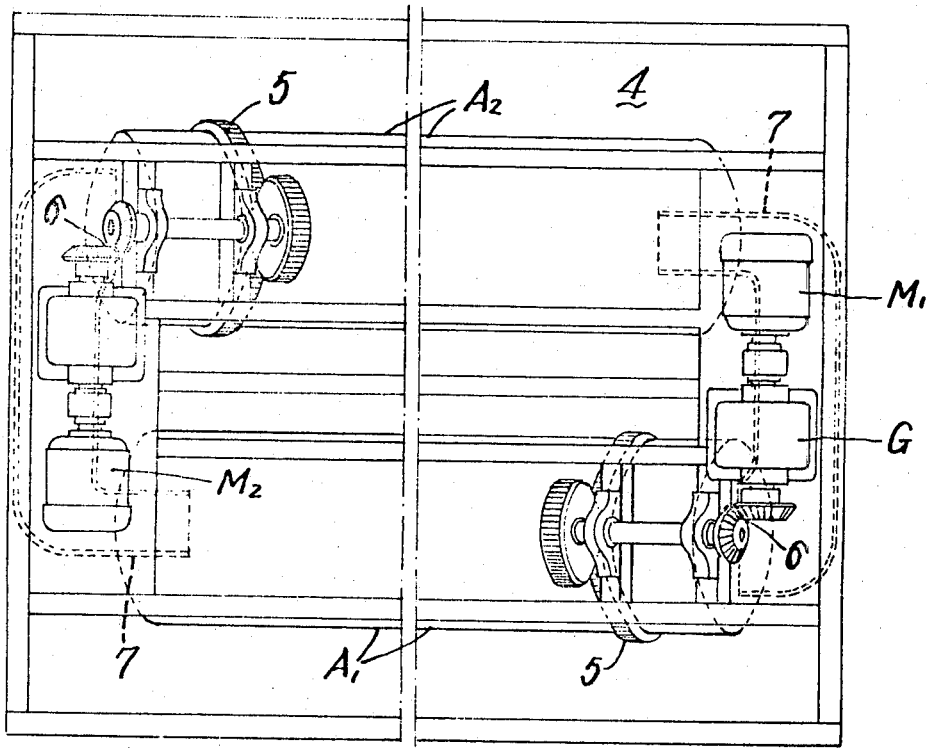
FIG. 3 is a plan view, partly in section, of the apparatus shown in FIG. 2.

The apparatus represented in FIG. 2 and FIG. 3 is a workpiece treating barrel designed to perform automatic circulation of barrel contents between a pair of the two barrels of the present invention so that the contents discharged by one barrel ($A_1$) are fed automatically to the inlet of the other barrel ($A_2$) and the contents discharged by the barrel ($A_2$) are returned to the first barrel ($A_1$). Each of said two barrels ($A_1$) and ($A_2$) is rotatably supported at an angle of approximately 15 degrees to the horizontal level so that they are shown intersecting each with other at their axis centers in a front elevation (FIG. 2). However, said barrels are disposed in parallel with each other in a plan view (FIG. 3). They are also supported by bearings (3) horizontally in a grinding tank (4) filled with a compound liquid, with its upper ends projecting above the liquid level (WL).

The barrels ($A_1$) and ($A_2$) are respectively driven by two motors ($M_1$) and ($M_2$) provided at both sides of the upper part of the grinding tank (4) through a flat gear-wheel transmission means (5), a bevel gear transmission means (6) co-operating therewith and a speed reduction means (G), each being provided on the outer peripheral surface of each of said barrels. Accordingly, said two barrels are rotated in the same direction. During the operation, said barrels treat the workpieces introduced from the lower ends of the barrels by means of stirring and forwarding action of said spiral flight (1) and said ancillary flight (2), and then discharge them from the upper ends of the barrels. The upper end of the barrel ($A_1$) and the lower end of the barrel ($A_2$) are connected together by a chute means (7) fixed to the inner side wall of the grinding tank (4). The workpieces discharged by the barrel ($A_1$) are delivered down into the lower end part of the other barrel ($A_2$) through said chute means (7). Further, another chute means (7) of same construction is provided between the upper end of the barrel ($A_2$) and the lower end of the barrel ($A_1$), thereby connecting said two barrels, through which the workpieces discharged by the barrel ($A_2$) is returned to the barrel ($A_1$). In the drawing, (7') indicates a freely openable discharge chute provided on one side of the chute means (7).

The workpiece treating barrel apparatus constructed as above is put into operation by starting the motors ($M_1$) and ($M_2$) simultaneously, upon which said two barrels are rotated simultaneously, thereby causing a mixture of workpieces and grinding media therein contained to circulate while keeping them submerged in the compound liquid of the grinding tank (4), through the chute means (7) provided at the both ends of the barrels.

In FIG. 2, (B) is a purifying device for the compound liquid in the tank (4), comprising a suction pipe (8), a pump (P), a fluid cyclon (9), a sludge recovery tank (10), a filter (11) and a water supply pipe (12). This device (B) is so designed that the compound liquid in the grinding tank (4) is sucked up by the pump (P) through the suction pipe (8), which is then treated by the fluid cyclon (9), the sludge recovery tank (10) and the filter (11) to remove any dust present in said liquid, and the compound liquid thus purified is returned to the grinding tank (4) through the supply pipe (12), thereby permitting the workpieces to be dipped and treated at all times in a clean compound liquid.

Figure 4:
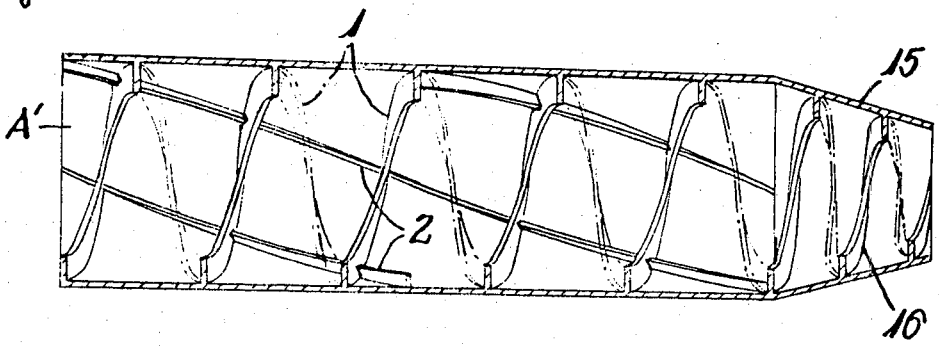
FIG. 4 is a vertical sectional view of another embodiment of the barrel according to the present invention.

The barrel shown in FIG. 4 is another embodiment of the present invention wherein the barrel (A) is connected at its end with a conical-shaped discharge tube (15) and a spiral flight (16) provided on the inner peripheral wall of said discharge tube (15) for the purpose of delivery only. This barrel (A) has an advantage in that, when used as a workpiece treating barrel as shown in FIG. 2 and FIG. 3, the distance of fall of the contents from the barrel ($A_1$) to the other barrel ($A_2$) is enlarged to smoothen the natural falling of the contents on the chute (7).

What is claimed:

1. A barrel apparatus for use in treating workpieces comprising a pair of rotary barrels of same structure and length rotatably mounted in a frame and disposed in such a manner that the axial lines of both barrels intersect with each other about their respective midpoints in the form of the letter X when viewed from the lateral side and lie parallel to each other when viewed from the top, each of said barrels having a first spiral flight provided on the inner peripheral wall of the barrel and at least one ancillary flight provided on the inner peripheral wall longitudinal of the barrel and intersecting said spiral flight, all of said flights extending from one end of the barrel to the other and each ancillary flight being lower in height than the first spiral flight, both of said barrels having means for simultaneously driving and rotating them fixed to the frame and being provided with chute means connecting the outlet upper end of each barrel with the inlet lower end of each other barrel.

2. The barrel apparatus of claim 1 wherein each ancillary flight extends in a substantially straight line disposed parallel to the axis of the barrel.

3. The barrel apparatus of claim 1 wherein each ancillary flight extends in an extremely modulated spiral form, and is slightly inclined in the same direction as the first spiral flight.

4. The apparatus of claims 1, 2 or 3 wherein the lower ends of both barrels are disposed in a grinding tank filled with a compounding liquid, said tank being provided with a compounding liquid purifying means having a pump means, whereby the compounding liquid is continuously removed from the grinding tank, settled and filtered so as to remove particles ground from the workpieces, and recycled to the grinding tank.

5. The apparatus of claims 1, 2 or 3 wherein a truncated conical-shaped discharge tube is provided at the upper end of each barrel, which tube has a second spiral flight provided on its inner peripheral wall, solely to afford means of forwarding the workpieces.

6. The apparatus of claim 4 wherein a truncated conical-shaped discharge tube is provided at the upper end of each barrel, which tube has a second spiral flight provided on its inner peripheral wall, solely to afford means of forwarding the workpieces.

7. The apparatus of claim 6 wherein each barrel is supported so that its axis is at an angle of approximately 15° to the horizontal, the axes of the pair of barrels defining approximately a 30° angle between them.

* * * * *